US011299376B2

(12) United States Patent
Klement et al.

(10) Patent No.: US 11,299,376 B2
(45) Date of Patent: Apr. 12, 2022

(54) METHOD FOR THE POSITIONALLY ACCURATE RECEIVING AND DEPOSITING OF A CONTAINER USING A GANTRY STACKER AND GANTRY STACKER FOR THIS PURPOSE

(71) Applicant: Konecranes Global Corporation, Hyvinkää (FI)

(72) Inventors: Stefan Klement, Rimpar (DE); Markus Wolz, Eisingen (DE)

(73) Assignee: Konecranes Global Corporation, Hyvinkää (FI)

( * ) Notice: Subject to any disclaimer, the term of this patent is extended or adjusted under 35 U.S.C. 154(b) by 415 days.

(21) Appl. No.: 16/500,326

(22) PCT Filed: Apr. 3, 2018

(86) PCT No.: PCT/EP2018/058465
§ 371 (c)(1),
(2) Date: Oct. 2, 2019

(87) PCT Pub. No.: WO2018/185088
PCT Pub. Date: Oct. 11, 2018

(65) Prior Publication Data

US 2021/0101787 A1 Apr. 8, 2021

(30) Foreign Application Priority Data

Apr. 3, 2017 (DE) ..... 102017107141.5

(51) Int. Cl.
*B66C 19/00* (2006.01)
*B66C 13/46* (2006.01)
*B66C 13/08* (2006.01)

(52) U.S. Cl.
CPC ..... *B66C 19/007* (2013.01); *B66C 13/085* (2013.01); *B66C 13/46* (2013.01)

(58) Field of Classification Search
CPC ..... B66C 13/085; B66C 13/46; B66C 19/007
See application file for complete search history.

(56) References Cited

U.S. PATENT DOCUMENTS 7,344,037 B1 3/2008 Zakula
2005/0242052 A1* 11/2005 O'Connor ..... B66C 19/007 212/344

(Continued)

FOREIGN PATENT DOCUMENTS

CN 102431895 B 12/2013
CN 103781717 A 5/2014

(Continued)

OTHER PUBLICATIONS

Preliminary Report on Patentability of the International Searching Authority in English from corresponding Patent Cooperation Treaty (PCT) Application No. PCT/EP2018/058465, completed Jun. 21, 2019.

(Continued)

*Primary Examiner* — Kaitlin S Joerger
(74) *Attorney, Agent, or Firm* — Gardner, Linn, Burkhart & Ondersma LLP

(57) ABSTRACT

A gantry stacker having a spreader for containers and including a locating system arranged on the gantry stacker that determines a position of the gantry stacker. To permit a more precise receiving or depositing of containers in a predefined position in a container terminal, sensors are arranged on the gantry stacker, with the sensors and the locating system being connected to a control unit, and the control unit determines a position of the spreader, of a container to be received or of a deposit site from the position of the gantry stacker using the signals from the sensors.

20 Claims, 5 Drawing Sheets

(56) References Cited

U.S. PATENT DOCUMENTS

| | | | | |
|---|---|---|---|---|
| 2006/0125258 | A1 | 6/2006 | Franzen et al. | |
| 2007/0289931 | A1* | 12/2007 | Henriksson | B66C 13/46 212/274 |
| 2014/0046587 | A1 | 2/2014 | Rintanen | |
| 2016/0122161 | A1* | 5/2016 | Mannari | G01B 11/24 700/275 |
| 2018/0050889 | A1* | 2/2018 | Fakkeldij | B66C 19/007 |
| 2019/0002251 | A1* | 1/2019 | Resch | B66C 13/22 |
| 2019/0218044 | A1* | 7/2019 | Keskitalo | B66C 13/52 |
| 2020/0031634 | A1* | 1/2020 | Klement | B66C 13/085 |
| 2020/0039798 | A1* | 2/2020 | Miyata | B66C 19/007 |
| 2021/0101787 | A1* | 4/2021 | Klement | B66C 13/46 |

FOREIGN PATENT DOCUMENTS

| | | | |
|---|---|---|---|
| DE | 202007016156 | U1 | 3/2008 |
| EP | 2128074 | A1 | 12/2009 |
| EP | 2096074 | B1 | 9/2011 |
| EP | 2910512 | A1 | 8/2015 |

OTHER PUBLICATIONS

International Search Report of the International Searching Authority from corresponding Patent Cooperation Treaty (PCT) Application No. PCT/EP2018/058465, indicated completed on Jun. 18, 2018.
International Preliminary Examination Report from corresponding Patent Cooperation Treaty (PCT) Application No. PCT/EP2018/058465 transmitted Jun. 21, 2019.

* cited by examiner

METHOD FOR THE POSITIONALLY ACCURATE RECEIVING AND DEPOSITING OF A CONTAINER USING A GANTRY STACKER AND GANTRY STACKER FOR THIS PURPOSE

CROSS REFERENCE TO RELATED APPLICATION

The present application claims the priority benefits of International Patent Application No. PCT/EP2018/058465, filed Apr. 3, 2018, and claims benefit of German patent application 10 2017 107 141.5, filed Apr. 3, 2017.

BACKGROUND AND FIELD OF THE INVENTION

The invention relates to a gantry lift stacker, in particular in the manner of a straddle carrier, having a spreader for containers and having a locating system arranged on the gantry lift stacker, said system determining a position of the gantry lift stacker which is different from the position of the spreader, of a container to be picked up or of a set-down location for containers. The invention also relates to a method for a gantry lift stacker for determining the position of a spreader, of a container to be picked up or of a set-down location for containers for positioning containers by means of a gantry lift stacker, in which positional data of the gantry lift stacker are determined via a locating system arranged on the gantry lift stacker.

Utility model DE 20 2007 016 156 U1 discloses a gantry lift stacker for containers which has steerable wheels as is typical. In order to unburden a driver having to steer—requiring concentration—along and over containers or between container rows and to permit higher travelling speeds of the gantry lift stacker, automatic steering is used as soon as the gantry lift stack approaches a set-down container, in particular a first container of a container row. For this purpose, a laser scanner is disposed at the front on one of the two travel supports of the gantry lift stacker and therefore laterally offset with respect to the respective container to be travelled over, the measurement signals of this laser scanner being used to determine a distance between the travel support and a side wall of the container. These distances are used for automatic steering purposes, and, on the basis thereof, desired steering angles are calculated for the turning of the wheels and are transmitted to a steering computer which controls the turning of the wheels. The use of laser scanners reduces the structural complexity compared with complete navigation systems such as radar navigation, transponders or DGPS.

Patent EP 2 096 074 B1 describes a fully automatic, driverless gantry lift stacker which is fitted with different sensor systems for vehicle locating and navigation. One of the sensor systems consists of a local radio locating system (LPR) for which a mobile radio base station is attached to the gantry lift stacker and for which a multiplicity of radio transponders are distributed in a stationary manner on the operating surface to be travelled on. In addition, a satellite-assisted differential global positioning system (DGPS) can also be used, for which a mobile DGPS receiver is attached on the gantry lift stacker. Signals from these sensor systems are combined in an electronic sensor merging system which precisely determines the coordinates of the respective current position of the gantry lift stacker. Together with an electronic path controller which has stored a multiplicity of predetermined travel paths for the gantry lift stacker, fully automatic and driverless steering, moving and positioning of the gantry lift stacker is thus possible. Moreover, a plurality of laser scanners are attached to the gantry lift stacker, by means of which automatic steering along and over a container row is rendered possible. When a container row is reached, a switch is automatically made from control on the basis of LPR and also DGPS to control on the basis of the laser scanners, and the gantry lift stacker is automatically guided over the container row.

US 2014/0046587A1 likewise discloses straddle carriers and, in this respect, a locating system which comprises two stationary orientation points with a known position, wherein the locating system is configured to measure the distance of the straddle carrier from the orientation points.

In contrast to gantry cranes which comprise crane trolleys which can move along their horizontal supports and between their gantry supports and have a lifting device for lifting and lowering the spreader for containers, the lifting device of corresponding gantry lift stackers or straddle carriers is stationary in relation to a gantry frame of the gantry lift stacker and in particular cannot move horizontally on the gantry frame. In gantry lift stackers, the spreader is thus moved in the horizontal direction by moving the entire gantry lift stacker, whereas in gantry cranes only the crane trolley and thus also the spreader on the gantry crane—which is otherwise not moved—can be moved in the horizontal direction.

SUMMARY OF THE INVENTION

The present invention provides a gantry lift stacker having a spreader for containers and having a locating system arranged on the gantry lift stacker and a method for a gantry lift stacker for determining the position of a spreader, of a container to be picked up or of a set-down location for containers for positioning containers by means of a gantry lift stacker, in order to permit more precise picking-up or setting-down of containers at a predetermined position in a container terminal.

In a gantry lift stacker having a spreader for containers and having a locating system arranged on the gantry lift stacker, said system determining a position of the gantry lift stacker, in order to permit more precise picking-up or setting-down of containers at a predetermined position in a container terminal it is proposed in accordance with the invention that sensors are arranged on the gantry lift stacker. The sensors and the locating system are connected to a control unit which is configured to determine, from the position of the gantry lift stacker, using the signals from the sensors, the position of the spreader and thus of a container picked up by the spreader, of a container to be picked up or of a set-down location.

The gantry lift stacker in accordance with the invention is a straddle carrier having a lifting device, secured to its gantry frame in a stationary manner, for the spreader in the sense of the above definition. The gantry frame of the straddle carrier includes a front first gantry frame part and a rear second gantry frame part which each have two vertical gantry supports extending with their respective longitudinal axis in parallel with the lifting and lowering direction, wherein the spreader is guided on the gantry supports of the gantry lift stacker during lifting and lowering.

The position of the gantry lift stacker which can be determined by means of the locating system comprises in particular at least two-dimensional positional data, i.e. a corresponding length and width or x and y coordinates in a local Cartesian coordinate system. The control unit is preferably a component of the gantry lift stacker and in this regard is alternatively integrated into the vehicle controller thereof or is formed as a separate unit and thereby optionally operatively connected to the vehicle controller.

The sensors arranged on the gantry lift stacker comprise for this purpose at least one sensor for determining an inclination of the gantry lift stacker, wherein the inclination can be represented in particular by a roll angle and/or a pitch angle of the gantry lift stacker. Accordingly, a separate inclination sensor can be provided for determining an inclination for each inclination angle, i.e. for the roll angle and also for the pitch angle. An inclination sensor which can determine both inclination angles is also feasible.

Furthermore, the sensors arranged on the gantry lift stacker comprise at least one sensor for determining a relative position of the spreader on the gantry lift stacker. This is intended to mean in particular a relative position of the spreader in relation to the gantry frame of the gantry lift stacker and preferably in relation to the relevant point defined for determining the position of the gantry lift stacker on the gantry frame. The relevant point is defined in particular by the locating system and preferably on the machine platform. The relative position of the spreader can be a lifting height in terms of a distance of the spreader, measured in particular in the lifting and lowering direction, relative to the gantry lift stacker or relative to the point relevant for determining the position of the gantry lift stacker. The lifting height or the distance can also be part of, or the basis for, a calculation of the relative position. Alternatively or in addition, the relative position can also include a three-dimensional position of the spreader relative to the relevant point in the form of corresponding positional data. With knowledge of the dimensions of containers picked up in the spreader, in particular container heights, widths and lengths, the relative positions or positional data of the spreader can be used to determine corresponding absolute positions of the spreader and thus also relative or absolute positions of containers picked up by the spreader and in particular also of the set-down location, e.g. if the container picked up by the spreader has already been set down at that location or is being set down with the position of the gantry lift stacker remaining the same. The same applies for setting containers down on a container stack or picking containers up therefrom. Preferably, the relative position of the spreader is measured from the machine platform.

The invention permits a more precise arrangement of containers within a container row or within the container terminal and the thus fewer deviations from an intended set-down location improves the utilisation of space within a container terminal. In this way, a displacement or inclination of the gantry lift stacker, in particular a longitudinal axis from one of its gantry supports, from vertical, but also design flexibilities of the gantry lift stacker, in particular the gantry supports, or deviations in the position of the spreader caused by present tolerances, which also depend upon the loading state of the gantry lift stacker, can advantageously be compensated for as a whole. The position of the spreader or the container is thus determined with maximised or maximum precision and the position of the gantry lift stacker known via the locating system is converted accordingly, in particular to the height of the position of the spreader in terms of the relative position and in particular lifting height of the spreader, of the container to be picked up or of the set-down location for containers. The sensors provide the necessary measurement values for this. According to one possible embodiment, this substantially relates to the relative height difference or distance between the height of the position of the spreader, of the container to be picked up or of the set-down location for containers and the position, known via the locating system, of the gantry lift stacker and via corresponding relative lateral displacements caused by deviations of the gantry lift stacker from vertical in terms of said inclinations and inclination angles.

The positional data are converted in particular when the position, in particular the horizontal position, of the spreader, of the container to be picked up or of the set-down location for containers is different from the position of the gantry lift stacker known via the locating system. This can be the case in particular with the described inclinations of the gantry lift stacker.

In a preferred manner, the position of the gantry lift stacker is determined by the locating system in the region of a machine platform of the gantry lift stacker. In other words, the position of the gantry lift stacker which can be determined by means of the locating system relates to the gantry frame thereof and in particular the machine platform at that location or in particular to a relevant point defined at that location.

In terms of design, provision is made that the locating system comprises a receiver and at least this receiver is arranged on the machine platform. Typically, the position of the receiver itself is the determining factor for the positional data received and evaluated by the locating system.

In a known manner, the locating system is based on radio, radar, GNSS, GPS or laser technology.

Preferably arranged on the gantry lift stacker in addition to or as one of the sensors is a sensor for determining a relative position of the spreader on the gantry lift stacker, via which in particular a lifting height of the spreader relative to the position of the gantry lift stacker can be determined and is determined. The lifting height corresponds in particular to a position of the spreader relative to the machine platform and measured in the lifting and lowering direction. In other words, e.g. the distance between the machine platform, in particular the locating system at that location, and the spreader can be determined via the sensor.

In one embodiment, provision is made that the sensor for determining a relative position of the spreader on the gantry lift stacker is attached to the lower side of the machine platform facing the spreader. In this regard, this sensor then preferably comprises at least one camera and/or at least one laser scanner which is directed towards a target mark applied to e.g. the centre of the spreader.

In a preferred embodiment, a sensor for determining an inclination of the gantry lift stacker, in particular an inclination sensor for determining a roll angle of the gantry lift stacker, is arranged on the gantry lift stacker as one of the sensors. Preferably combined therewith is the fact that a sensor for determining an inclination of the gantry lift stacker, in particular an inclination sensor for determining a pitch angle of the gantry lift stacker, is arranged on the gantry lift stacker as one of the sensors.

In one embodiment, provision is made that the control unit is electrically connected to said sensors and the locating system and exchanges data therewith.

In order to process the data, in particular positional data, or corresponding signals, provision is made that the signals from the sensors and from the locating system are processed in the control unit for determining the position of the spreader, of a container to be picked up or of a set-down location for containers, and the position is forwarded to the travel drives, the lifting drives and/or a driver of the gantry lift stacker as navigational data.

The invention is particularly suitable for use in an arrangement consisting of a storage area on a ground surface and of a gantry lift stacker in accordance with the invention.

In accordance with the invention, in a method for a gantry lift stacker for determining the position of a spreader, of a container to be picked up or of a set-down location for containers for positioning containers by means of a gantry lift stacker, in which positional data of the gantry lift stacker are determined via the locating system arranged on the gantry lift stacker, in order to allow containers to be picked up or set down more precisely at a predetermined position in a container terminal, it is proposed that the position of the spreader, of the container to be picked up or of the set-down location is determined from the positional data of the gantry lift stacker with the aid of the control unit and using data, in particular positional data, or corresponding signals from the sensors arranged on the gantry lift stacker. In relation to the advantages associated herewith, reference is made to the above statements in relation to the gantry lift stacker.

In a particularly advantageous manner, provision is hereby made that by means of a sensor additionally arranged on the gantry lift stacker or by means of one of the sensors which is arranged on the gantry lift stacker in the above-described sense for determining a relative position of the spreader, in particular a lifting height of the spreader relative to the position of the gantry lift stacker is determined and is processed by the control unit, in particular for determining the position of the spreader. The lifting height corresponds in particular to a position of the spreader relative to the machine platform and measured in the lifting and lowering direction. In other words, e.g. the distance between the machine platform, in particular the locating system at that location, and the spreader can be determined via the sensor.

The gantry lift stacker in accordance with the invention and also the method in accordance with the invention can be used in a particularly advantageous manner to pick up and set down containers by means of such a gantry lift stacker in a fully automatic manner.

In the context of the invention, containers are understood to be ISO containers. ISO containers weigh up to about 38 t and are generally understood to be normed bulk containers with normed pick-up points or corners for load picking-up means. ISO containers are conventionally 20, 40 or 45 feet long. ISO containers with a length of 53 feet also already exist. In the field of ISO containers, in addition to the closed containers, refrigerated containers—so-called reefers—and a multiplicity of other container types are also known.

The invention is explained in more detail hereinunder with the aid of an exemplified embodiment illustrated in the drawings.

DESCRIPTION OF THE PREFERRED EMBODIMENTS

Figure 1:
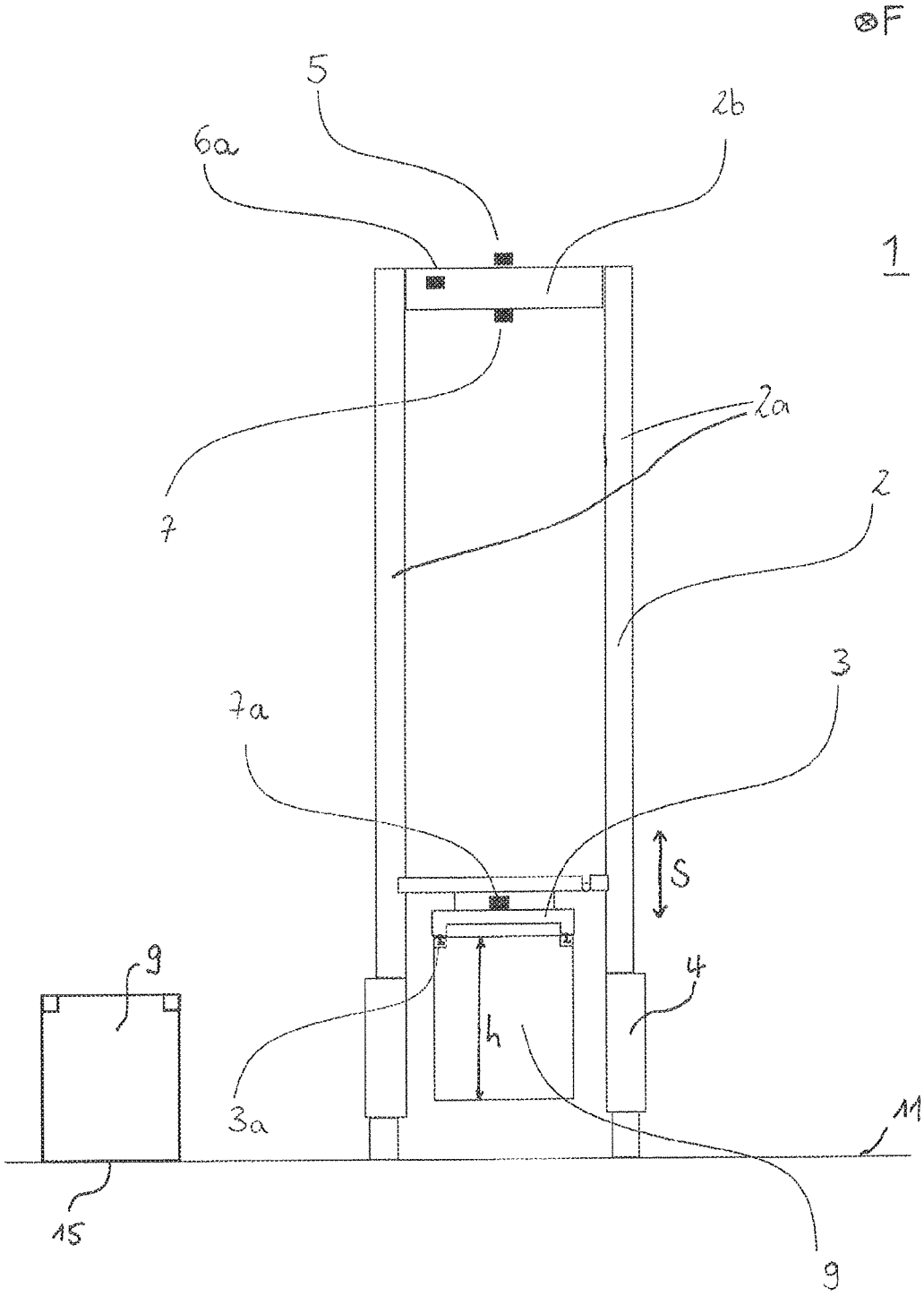
FIG. 1 shows a front view of a gantry lift stacker.

FIG. 1 illustrates a front view of a gantry lift stacker, also known as a straddle carrier, designated by the reference numeral 1. The gantry lift stacker 1 substantially comprises a downwardly-open U-shaped gantry frame 2, a load picking-up means in the form of a so-called spreader 3 and two travel supports 4. The gantry frame 2 can be theoretically divided, as seen in a direction of travel F of the gantry lift stacker 1, into a front first gantry frame part and a rear second gantry frame part. Each gantry frame part has two vertical gantry supports 2*a* extending with their respective longitudinal axis in parallel with the lifting and lowering direction S. "Vertical" relates in this case to the situation shown in FIG. 1, in which the gantry lift stacker 1 is located on ideally flat and horizontally extending ground 11. The two gantry frame parts are connected to each other at their upper ends via a horizontal and frame-like machine platform 2*b*. The two left and right gantry supports 2*a* as seen in the direction of travel F are supported at their lower ends on the two travel supports 4. In a typical manner, the gantry lift stacker 1 with this design can travel over a container 9 or, depending upon the structural height, over a plurality of containers 9 stacked one on top of another, can pick up this container 9 or the uppermost container 9 with its spreader 3, can move the picked-up container 9 to a target location and at that location can set down the container on the ground 11, on an already set down container 9 or on a stack of containers. In this case, the containers 9 are typically arranged in rows and are oriented within the respective row each with their longitudinal direction in the longitudinal direction of the row. The spreader 3 is provided in each of its four corners with a so-called twist lock 3*a* in a typical manner in order to connect the containers 9 to the spreader 3 for the transport process with low tolerance. In so-called twin lift spreaders, eight twist locks 3*a* are accordingly provided in order to be able to pick up two short 20 foot containers 9 together one behind the other as seen in the direction of travel F by a spreader 3. The spreader 3 can be lifted and lowered vertically along the vertical gantry supports 2*a* of the gantry frame 2 in a lifting/lowering direction S. During lifting and lowering, the spreader 3 is guided on the gantry supports 2*a* such that in particular swinging of the spreader 3 relative to the longitudinal axis of the gantry supports 2*a* is minimised. The lifting device provided for lifting and lowering the spreader 3 is arranged on the gantry lift stacker 1 to be stationary in terms of the above definition.

In order to be able to determine a current position of the gantry lift stacker 1 e.g. in the area of a port terminal, a locating system 5—also known under the designation Position Detection System (PDS)—is located on the machine platform 2*b* for locating the gantry lift stacker 1 and includes at least one locating system, alternatively two independent locating systems. The locating system can be based e.g. on radio, radar, GNSS, GPS or laser technology. The determined position of the gantry lift stacker 1 in terms of indicating the length and width or x and y coordinates in a local Cartesian coordinate system is placed in relation to the known point of attachment to the machine platform 2*b* in order thus to obtain a precise position of the gantry lift stacker 1 or the boundaries of the gantry lift stacker 1 as seen in plan view. The boundaries are formed in particular by outer contours of the gantry supports 2*a*. Since the attachment point of the locating system 5 is located at the height of the machine platform 2*b*, the positional data also relate to this height and not to the height of the travel supports 4, the respective height of a set-down or pick-up location for a container 9 or the ground 11 on which the gantry lift stacker 1 moves. Typically, the locating system 5 is also used in parallel for navigating the gantry lift stacker 1. In the context of the present invention, the locating system 5 is—in the sense of a receiver part of the locating system 5 receiving the positional data—i.e. for example an antenna of the locating system 5 because this generates the relevant reference of the positional data to the gantry lift stacker 1. The positional data received from the locating system 5 can then also be processed locally, separate from the receiver of the locating system 5.

In order to be able to also relate the positional data—determined by means of the locating system 5 and related to the height of the machine platform 2*b*—with a high level of precision to other components of the gantry lift stacker 1, in particular beneath the machine platform 2*b*, the knowledge of a possible inclination of the gantry lift stacker 1 in and opposite to the direction of travel F in terms of a pitch angle N and, transverse thereto, in terms of a roll angle W is necessary. In order to determine a current inclination of the gantry lift stacker 1 starting from a vertical and thus on uneven or non-horizontal ground 11, at least one front or rear first inclination sensor 6*a* is provided on a front or rear side of the machine platform 2*b* pointing in or opposite the direction of travel F and at least one lateral second inclination sensor 6*b* is provided on a lateral side of the machine platform 2*b* pointing transverse to the direction of travel F, in order to be able to detect the pitch angle N and the roll angle W with a high level of precision (see also FIG. 2). In this context, uneven or non-horizontal ground 11 is understood to mean ground 11 on which the gantry lift stacker 1, in particular with the longitudinal axes of its gantry supports 2*a*, is or is moving not vertically but inclined with respect thereto. Basically, other points of attachment for the front first inclination sensor 6*a* and the lateral second inclination sensor 6*b* on the gantry lift stacker 1 and also combined inclination sensors for pitch angle N and roll angle W or the measurement thereof and redundant designs thereof are feasible. The knowledge of the pitch angle N and the roll angle W is important for precise positioning of the containers 9 and precisely approaching set-down containers 9 or an empty set-down location 15 on the ground 11 and will be of even greater importance as gantry lift stackers 1 become ever taller.

In addition to the positional data of the locating system 5, the roll angle W and the pitch angle N, a current relative position of the spreader 3 on and thus in relation to the gantry lift stacker 1 should still be determined to determine a current position of the spreader 3, in particular in the form of absolute positional data of the spreader 3 which are as precise as possible. The respective position of the spreader 3 can then be used, as described below, to also simply determine the corresponding position of a transported container 9 picked up by the spreader 3.

The relative position of the spreader 3 thus relates in the above sense in particular to the gantry frame 2 or the point relevant for determining the position of the gantry lift stacker 1, which point is defined e.g. by the locating system 5 on the machine platform 2*b*. Such a current relative position of the spreader 3 can be, in terms of a distance, the current lifting height of the spreader 3 relative to the gantry lift stacker 1 or relative to the locating system 5 on the machine platform 2*b* of the gantry frame 2 and/or can contain or be based on this height. The spreader 3 is typically fixedly connected to the container 9 via twist locks 3*a*. Depending upon whether the position of the container 9 is intended to relate to the upper side or lower side thereof, knowledge of the height h of the container 9 is also necessary, said height either being normed or being made available via a store management computer. A further sensor, not described, can also be used for this purpose.

In order to determine the height and thus the current lifting height H of the spreader 3 as its relative position on the gantry lift stacker 1 or as part of, or the basis for, the position calculation, a sensor 7 is provided on the lower side of the machine platform 2*b* facing the spreader 3, via which sensor the distance between the machine platform 2*b*, in particular the locating system 5 at that location, and the spreader 3 can be determined. The distance relates to the lifting and lowering direction S in parallel with the longitudinal axes of the gantry supports 2*a*. A detailed and in particular three-dimensional relative position determination of the spreader 3 in relation to the gantry frame 2 or the machine platform 2*b* can be effected by means of the sensor 7. The sensor 7 can be formed as a camera or as a laser scanner which is directed towards a target mark 7*a*. In a corresponding manner, the target mark 7*a* is located centrally on the upper side of the spreader 3 facing the sensor 7.

It is hereby possible on the whole, when lifting or lowering the spreader 3 vertically or in an inclined manner along the vertical or inclined gantry supports 2*a* of the gantry frame 2 in the lifting/lowering direction S, which is substantially in parallel with the longitudinal axis of the gantry supports 2*a*, to correspondingly correct and thus optimise—in addition to the current position of the gantry lift stacker 1 which relates to a height of the machine platform 2*b* and the location system 5 at that location—these positional data via the now known roll angle W, pitch angle N and lifting height H or distance of the spreader 3 and the height h of the container 9 for the container 9 to be approached and to be picked up, the empty set-down location 15 to be approached or a container 9 picked up by the spreader 3. Therefore, the current position of the spreader 3 and of a possibly picked up container 9 or of an empty set-down location 15 to be approached or of an already set down container 9 to be approached and to be picked up can be determined with maximised or maximum precision and the container 9 can be lowered or picked up with a high level of precision, in particular in a fully automatic manner.

Figure 2:
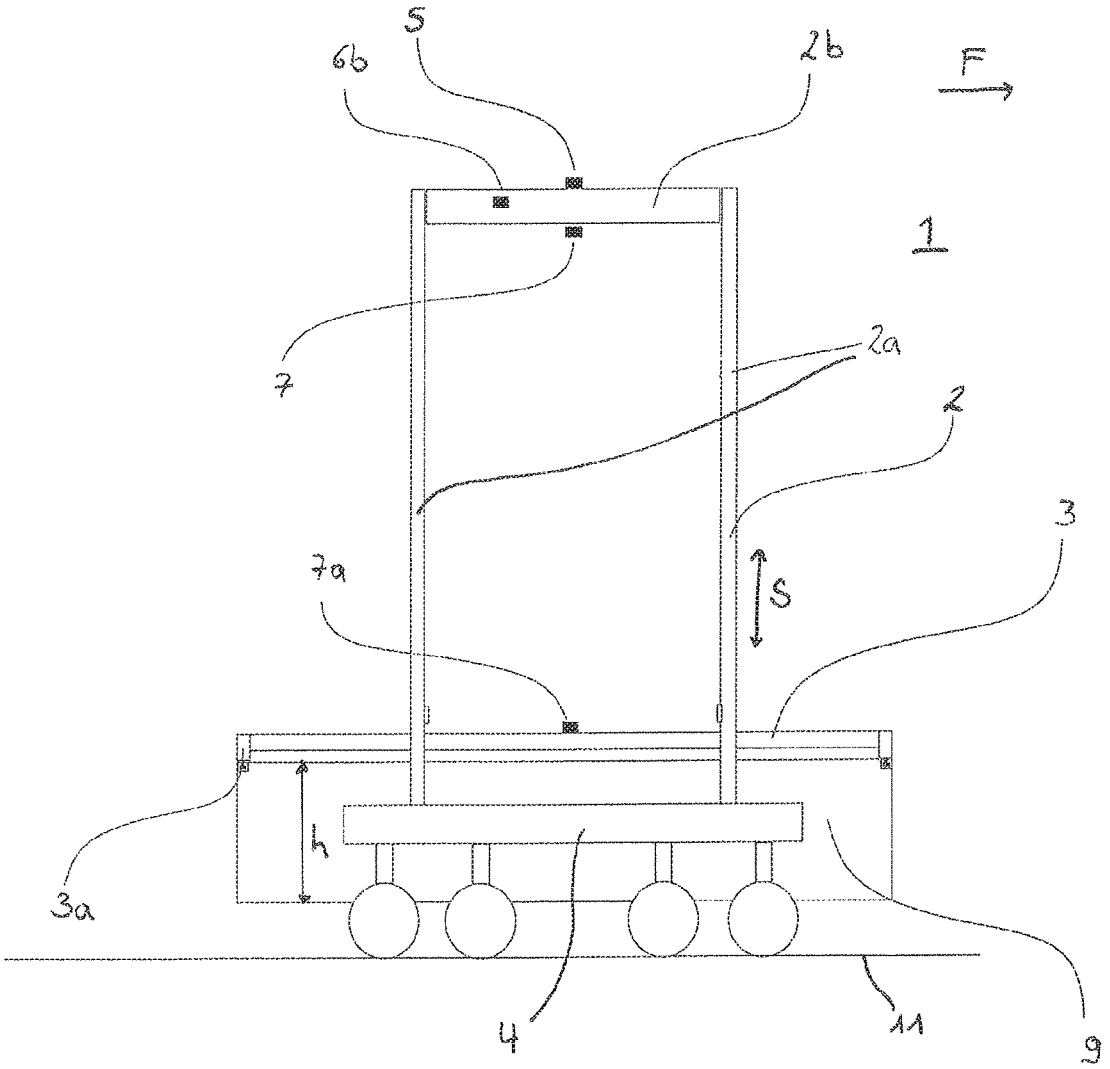
FIG. 2 shows a side view of a gantry lift stacker.
Figure 5:
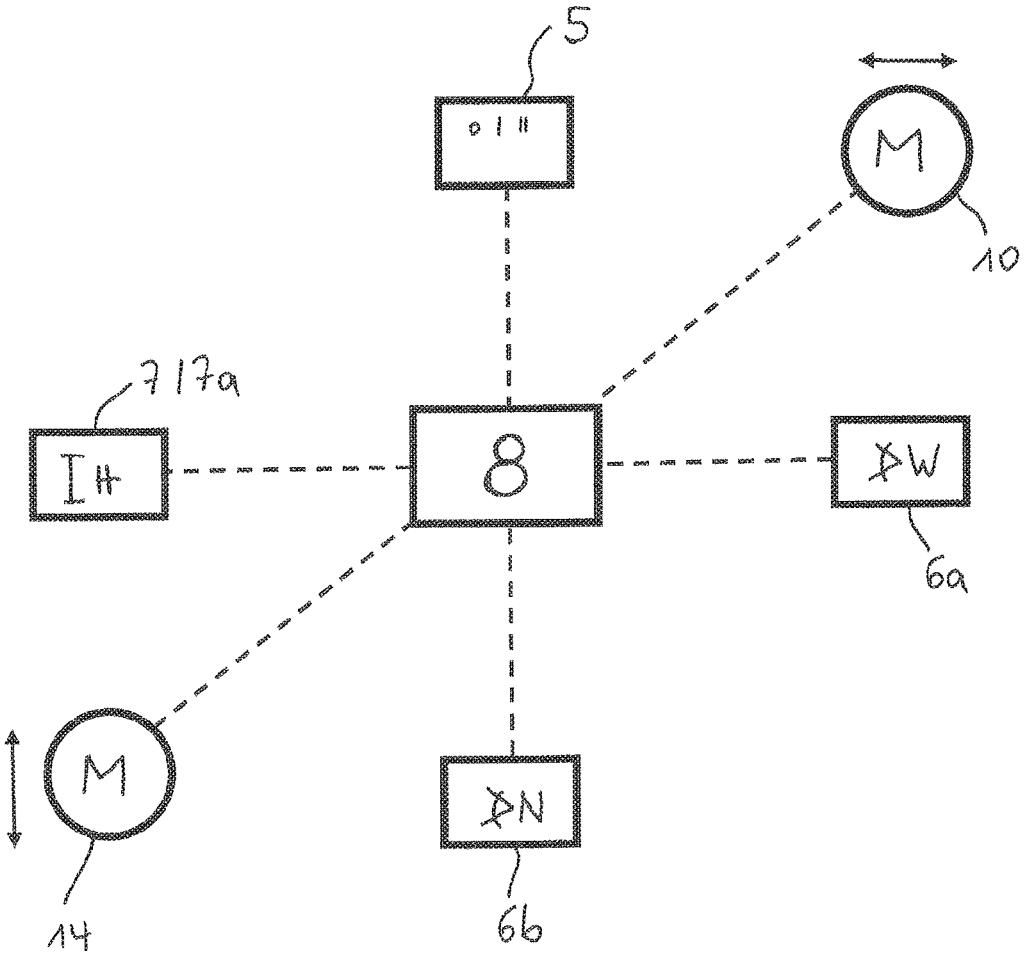
FIG. 5 shows a block diagram with a control unit of the gantry lift stacker.

FIG. 2 shows a side view of the gantry lift stacker 1 of FIG. 1. The locating system 5 is arranged centrally on an upper side of the machine platform 2*b* of the gantry lift stacker 1. The sensor 7 can be seen on the lower side of the machine platform 2*b* and the target mark 7*a* can be seen on the upper side of the spreader 3. The travel supports 4, on which the travel drives 10 having rubber-tyred and pneumatic wheels and schematically illustrated in FIG. 5 are arranged, are located at each of the lower ends of the gantry supports 2*a*. In a typical manner, the gantry lift stacker 1 with this design can travel over a container 9 or, depending upon the structural height, over a plurality of containers 9 stacked one on top of another, can pick up this container with its spreader 3 via twist locks 3*a* in its four corners, can move the picked-up container to a target location and at that location can set down the container on the ground 11, on an already set down container 9 or on a stack of containers. It is obvious that, instead of the combination of sensor 7 and target mark 7*a*, other sensors can also be used in order to determine the relative position, and in this context as a distance, the lifting height H of the spreader 3.

Figure 3:
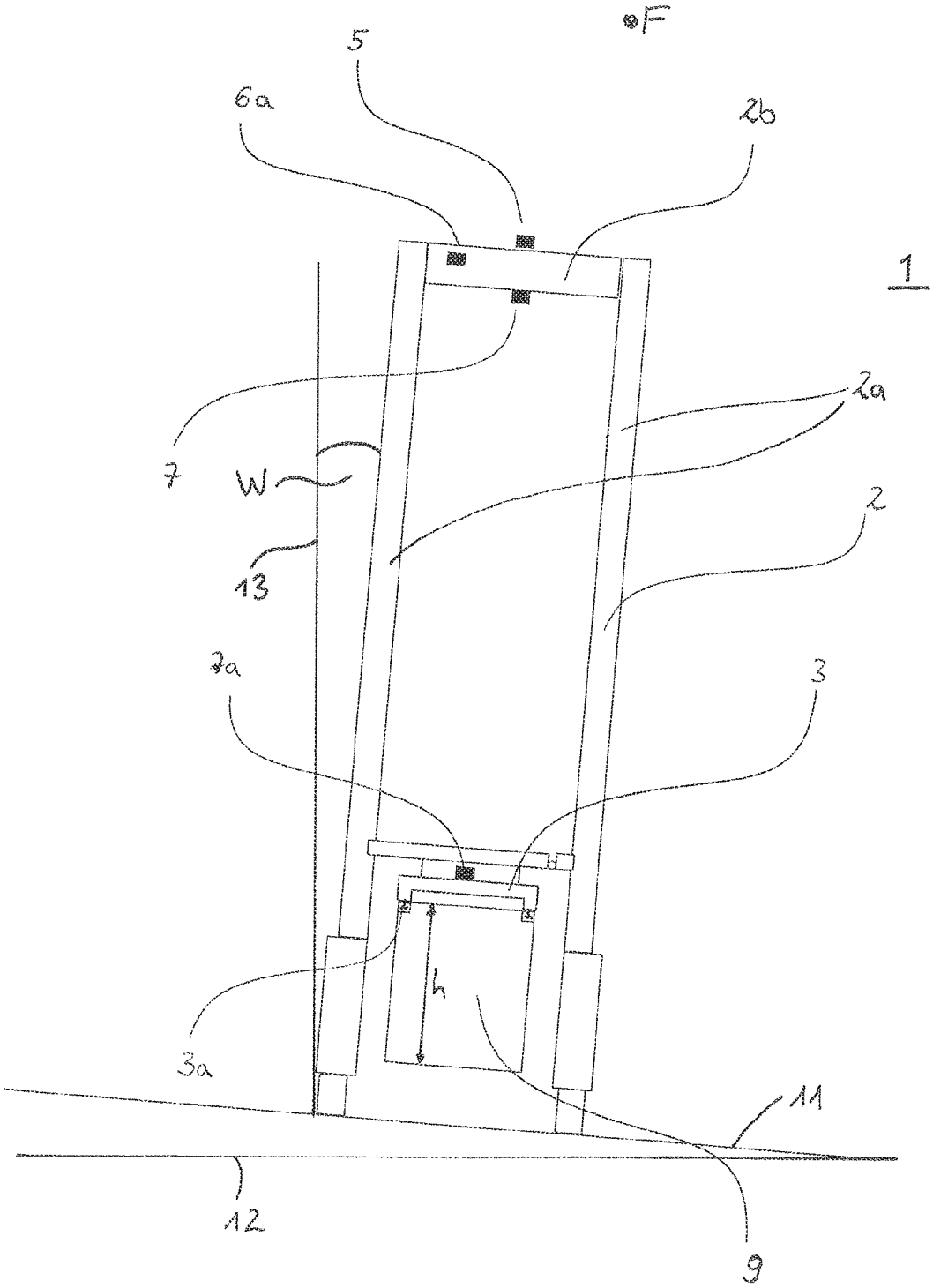
FIG. 3 shows a gantry lift stacker of FIG. 1 on inclined ground.

FIG. 3 shows a front view of the gantry lift stacker 1 of FIG. 1 standing on the ground 11. The ground 11, as seen in the direction of travel F, rises from a notional horizontal plane 12 transverse to the direction of travel F so that a gantry lift stacker 1 standing or moving on the ground 11 is inclined away from a vertical position towards the right by a roll angle W. In this regard, the roll angle W is formed between the vertical 13 and the lateral boundary of a gantry support 2*a*, wherein the boundary is formed in particular by an outer contour of the gantry supports 2*a* extending in parallel with the longitudinal axis of the gantry supports 2*a*. As a result, inclined positions or inclinations of the gantry lift stacker 1 to the right and left can be detected. A corresponding orientation of the gantry lift stacker 1 can of course also be present on uneven ground 11 in terms of a surface which is undulating or angled rather than entirely flat. In FIG. 3, the ground 11 is shown ideally as a flat and inherently inclined surface, i.e. a surface inclined with respect to the notional ideal flat and horizontal plane 12.

Figure 4:
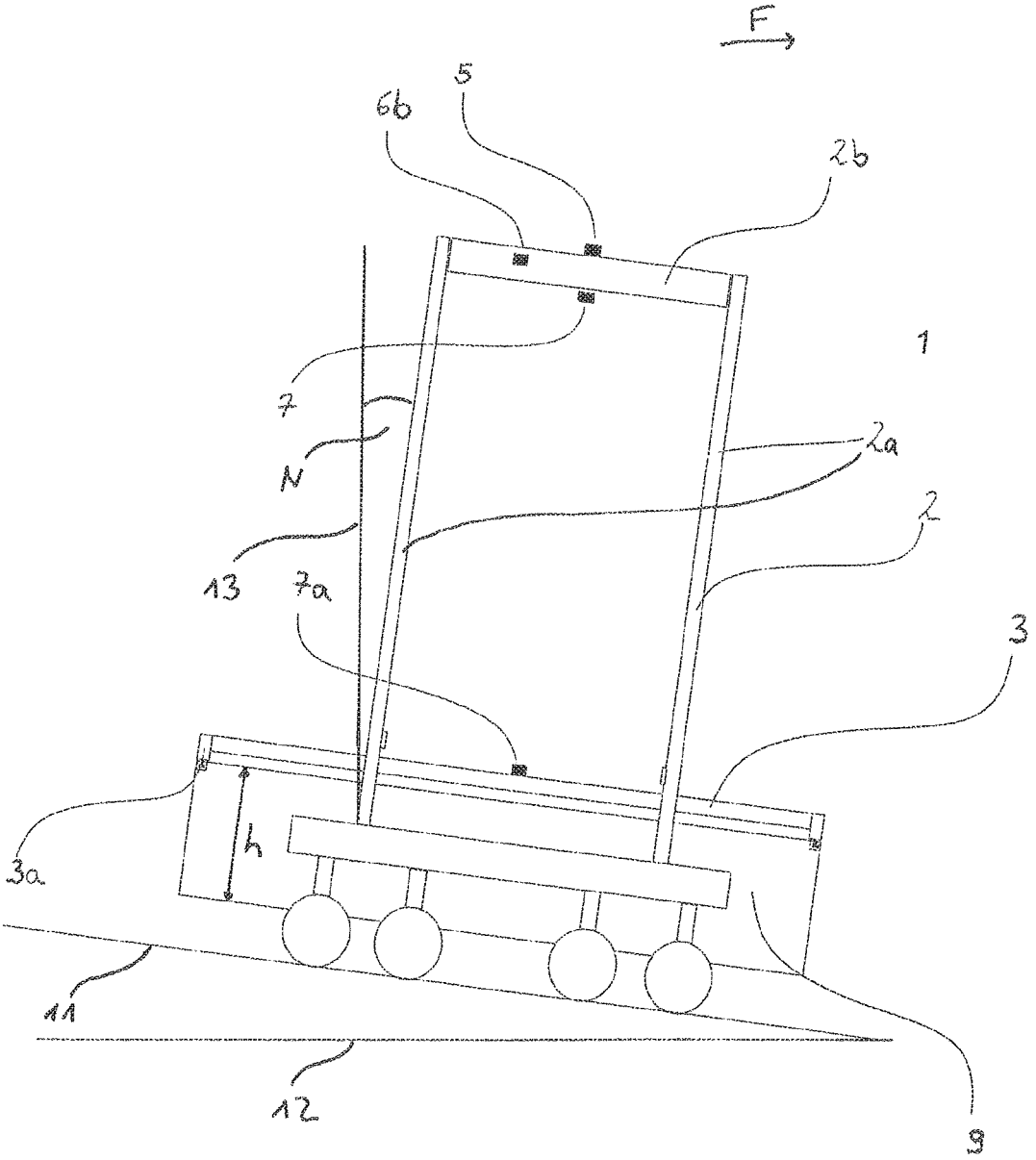
FIG. 4 shows a gantry lift stacker of FIG. 2 on inclined ground.

FIG. 4 shows a side view of the gantry lift stacker 1 of FIG. 2 standing on the ground 11. The ground 11, as seen in the direction of travel F, decreases from a notional horizontal plane 12 in the direction of travel F so that a gantry lift stacker 1 standing or moving on the ground 11 is inclined forwards away from a vertical position in the direction of travel F by a pitch angle N. In this regard, the pitch angle N is formed between the vertical 13 and the rear boundary of a gantry support 2*a*, wherein the boundary is formed in particular by an outer contour of the gantry supports 2*a* extending in parallel with the longitudinal axis of the gantry supports 2*a*. As a result, inclined positions or inclinations of the gantry lift stacker 1 to the front and rear can be detected. A corresponding orientation of the gantry lift stacker 1 can of course also be present on uneven ground 11 in terms of a surface which is undulating or angled rather than entirely flat. In FIG. 4 also, the ground 11 is shown ideally as a flat and inherently inclined surface, i.e. a surface inclined with respect to the notional ideal flat and horizontal plane 12.

The mode of operation of the invention will be described in more detail hereinafter with the aid of FIG. 5. FIG. 5 illustrates a block diagram which shows the individual sensors 6*a*, 6*b*, 7 which are used for determining the precise position of the spreader 3 or of the container 9 picked up by the spreader 3, and the locating system 5 which are electrically connected to a central control unit 8 and exchange data therewith. This control unit 8 processes the location coordinates obtained by the locating system 5 which are indicated in a typical manner in degrees, minutes and seconds—°, ', "—the relative position of the spreader, obtained by the sensor 7 and the target mark 7*a*, with the lifting height H, determined as a distance for this purpose, the pitch angle N which is determined and transmitted by the corresponding inclination sensor 6*a* and the roll angle W which is determined and transmitted by the corresponding inclination sensor 6*b* in order to convert the position, known by the locating system 5, of the gantry lift stacker 1 in the region of the machine platform 2*b* to the absolute position of the spreader 3. Using the thus obtained absolute position of the spreader 3, the travel drives 10 and lifting drives 14 of the gantry lift stacker 1 are actuated by the control unit 8, or a driver of the gantry lift stacker 1 is provided with corresponding navigational data. Therefore, it is possible for the gantry lift stacker 1 to set down or pick up a container 9 at a precise position on or from the predetermined target position.

The control unit 8 can be formed as a separate unit as in the exemplified embodiment of FIG. 5 or can also be integrated into a vehicle controller of the gantry lift stacker 1.

In order to pick up a container 9, the gantry lift stacker 1 is moved, using the travel drives 10, over a container 9 to be picked up. This occurs e.g. by manually controlling the travel drives 10, in so doing the gantry lift stacker 1 is steered to the desired position e.g. manually by a driver and alternatively supported by a navigation system which uses the positional data of the spreader 3 of the control unit 8. The desired position is here the position of the spreader 3 at the lifting height H of the planned pick-up, i.e. with a corresponding distance of the spreader 3 from the machine platform 2*b* and the relevant point defined at that location for determining the position of the gantry lift stacker 1. Alternatively or in addition, automatic control of the gantry lift stacker 1 and thus of the travel drives 10 and the lifting drives 14 supported by the positional data of the spreader 3 of the control unit 8 is also feasible. In this way, in addition to the displacement or inclination of the gantry lift stacker 1 from vertical, also design flexibilities of the gantry lift stacker 1, in particular the gantry supports 2*a*, or deviations in the position of the spreader 3 caused by present tolerances, which also depend upon the loading state of the gantry lift stacker 1, can advantageously be compensated for as a whole. The position of the spreader 3 or of the container 9 is thus determined with maximum precision. The container 9 is then picked up by the spreader 3 and is connected to the spreader 3 by means of a typical twist lock with low tolerance. The position of the container 9 is thus sufficiently precisely defined by the connection to the spreader 3. The container 9 is then lifted by the spreader 3.

The gantry lift stacker 1 is then moved to a desired position, e.g. to the desired set-down area or set-down location 15 of the container 9 and the spreader 3 is lowered in order to set down the container 9. For the case where the container 9 is picked up, the position of the spreader 3 or of the container 9 is determined by the control unit 8 in order then to set down the container 9 at the intended set-down area or set-down location 15 with maximum precision.

As a result, a more precise arrangement of containers 9 within a container row or within the container terminal is rendered possible and the thus fewer deviations from an intended set-down location 15 improves the utilisation of space within a container terminal.

The invention claimed is:

1. A gantry lift stacker comprising a straddle carrier having a spreader for containers and having a front first gantry frame part and a rear second gantry frame part which each have two vertical gantry supports extending with their respective longitudinal axis in parallel with the lifting and lowering direction, wherein the spreader is guided on the gantry supports of the gantry lift stacker during lifting and lowering and a lifting device for the spreader is attached to a gantry frame of the gantry lift stacker in a stationary manner, and having a locating system arranged on the gantry lift stacker, said locating system determining a position of the gantry lift stacker, wherein the locating system determines the position of the gantry lift stacker in relation to a point defined on a machine platform of the gantry lift stacker, wherein sensors are arranged on the gantry lift stacker, and wherein the sensors and the locating system are connected to a control unit, and wherein the control unit determines, from the position of the gantry lift stacker, using the signals from the sensors, a position of the spreader, of a container to be picked up or of a set-down location, and wherein the sensors arranged on the gantry lift stacker comprise at least one sensor for determining an inclination of the gantry lift stacker and at least one sensor for determining a relative position of the spreader on the gantry lift stacker, and wherein the relative position relates to the point defined on the machine platform for determining the position of the gantry lift stacker and includes a distance, measured in the lifting and lowering direction, of the spreader relative to the point defined on the machine platform for determining the position of the gantry lift stacker.

2. The gantry lift stacker as claimed in claim 1, wherein the position of the gantry lift stacker differs from the position of the spreader, of a container to be picked up or of a set-down location for containers.

3. The gantry lift stacker as claimed in claim 1, wherein the locating system comprises a receiver and at least this receiver is arranged on the machine platform.

4. The gantry lift stacker as claimed in claim 3, wherein the locating system is based on radio, radar, GNSS, GPS or laser technology.

5. The gantry lift stacker as claimed in claim 1, wherein arranged on the gantry lift stacker as one of the sensors is a sensor for determining a relative position of the spreader on the gantry lift stacker, via which a lifting height of the spreader relative to the position of the gantry lift stacker can be determined and is determined.

6. The gantry lift stacker as claimed in claim 5, wherein the sensor for determining a relative position of the spreader on the gantry lift stacker is attached to the lower side of the machine platform facing the spreader.

7. The gantry lift stacker as claimed in claim 6, wherein the sensor for determining a relative position of the spreader on the gantry lift stacker comprises at least one camera and/or at least one laser scanner which is directed towards a target mark applied to the center of the spreader.

8. The gantry lift stacker as claimed in claim 7, wherein the sensor for determining an inclination of the gantry lift stacker is an inclination sensor for determining a roll angle of the gantry lift stacker.

9. The gantry lift stacker as claimed in claim 8, wherein the sensor for determining an inclination of the gantry lift stacker is an inclination sensor for determining a pitch angle of the gantry lift stacker.

10. The gantry lift stacker as claimed in claim 9, wherein the control unit is electrically connected to the sensors and the locating system and exchanges data therewith.

11. The gantry lift stacker as claimed in claim 10, wherein the signals from the sensors and from the locating system are processed in the control unit for determining the position of the spreader, of a container to be picked up or of a set-down location for containers, and the position is forwarded to the travel drives, the lifting drives and/or a driver of the gantry lift stacker as navigational data.

12. The gantry lift stacker as claimed in claim 11, wherein the sensor for determining an inclination of the gantry lift stacker is an inclination sensor for determining a roll angle of the gantry lift stacker.

13. The gantry lift stacker as claimed in claim 1, wherein the sensor for determining an inclination of the gantry lift stacker is an inclination sensor for determining a pitch angle of the gantry lift stacker.

14. The gantry lift stacker as claimed in claim 1, wherein the control unit is electrically connected to the sensors and the locating system and exchanges data therewith.

15. The gantry lift stacker as claimed in claim 1, wherein the locating system is based on radio, radar, GNSS, GPS or laser technology.

16. The gantry lift stacker as claimed in claim 3, wherein arranged on the gantry lift stacker as one of the sensors is a sensor for determining a relative position of the spreader on the gantry lift stacker, via which a lifting height of the spreader relative to the position of the gantry lift stacker can be determined and is determined.

17. The gantry lift stacker as claimed in claim 2, wherein the locating system comprises a receiver and at least this receiver is arranged on the machine platform.

18. An arrangement of a gantry lift stacker, said arrangement comprising a storage area on a ground surface and of a gantry lift stacker as claimed in claim 1.

19. A method for a gantry lift stacker for determining the position of a spreader, of a container to be picked up or of a set-down location for containers for positioning containers by a gantry lift stacker comprising a straddle carrier as claimed in claim 1, said method comprising:

determining positional data of the gantry lift stacker via the locating system arranged on the gantry lift stacker; and determining a position of the spreader, of the container to be picked up or of the set-down location from the positional data of the gantry lift stacker with the aid of the control unit and using data from the sensors arranged on the gantry lift stacker.

20. The method as claimed in claim 19, wherein in order to determine a relative position of the spreader on the gantry lift stacker by means of a sensor arranged on the gantry lift stacker, a lifting height of the spreader relative to the position of the gantry lift stacker is determined and is processed by the control unit.

* * * * *